US006867383B1

(12) United States Patent
Currier

(10) Patent No.: US 6,867,383 B1
(45) Date of Patent: Mar. 15, 2005

(54) LIQUID LEVEL ASSEMBLY WITH DIAPHRAGM SEAL

(75) Inventor: Jon D. Currier, Edmond, OK (US)

(73) Assignee: Little Giant Pump Company, Oklahoma City, OK (US)

( * ) Notice: Subject to any disclaimer, the term of this patent is extended or adjusted under 35 U.S.C. 154(b) by 0 days.

(21) Appl. No.: 10/810,967

(22) Filed: Mar. 26, 2004

Related U.S. Application Data

(60) Provisional application No. 60/458,478, filed on Mar. 28, 2003.

(51) Int. Cl.[7] ..... H01H 35/34
(52) U.S. Cl. ..... 200/83 R
(58) Field of Search ..... 200/83 R, 83 B, 200/83 J, 83 N, 83 P, 83 V, 83 Y

(56) References Cited

U.S. PATENT DOCUMENTS

| | | | | |
|---|---|---|---|---|
| 4,038,506 A | | 7/1977 | Filip | |
| 4,192,192 A | | 3/1980 | Schnell | |
| 4,260,862 A | * | 4/1981 | Orcutt | 200/81 R |
| 4,885,983 A | | 12/1989 | Zavoda | |
| 5,062,455 A | | 11/1991 | Schurter et al. | |
| 5,073,149 A | | 12/1991 | Maruyama et al. | |
| 5,115,724 A | | 5/1992 | Zavoda | |
| 5,125,228 A | | 6/1992 | Jewess et al. | |
| 5,471,022 A | * | 11/1995 | Kiss et al. | 200/83 B |
| 5,661,278 A | * | 8/1997 | Atkinson et al. | 200/83 J |
| 5,667,060 A | | 9/1997 | Luzzi | |
| 5,672,049 A | * | 9/1997 | Ciurlo | 417/44.1 |
| 5,744,770 A | * | 4/1998 | Moessinger et al. | 200/83 A |
| 6,120,033 A | | 9/2000 | Filippi et al. | |
| 6,244,457 B1 | | 6/2001 | Piotrowski et al. | |
| 6,484,555 B1 | * | 11/2002 | Perry et al. | 73/1.71 |

* cited by examiner

*Primary Examiner*—Michael A. Friedhofer
(74) *Attorney, Agent, or Firm*—Bill D. McCarthy; Fellers, Snider, et al.

(57) ABSTRACT

A liquid level assembly for controlling liquid level has a switching mechanism responsive to the liquid head to activate a pump. A housing assembly has an internal cavity in which the switching mechanism is supported, the housing assembly having an open end sealed by a diaphragm seal having a flexible planar portion that transmits head pressure to the switching mechanism. The diaphragm seal also has a peripheral web portion and a flexible bellows portion connecting the flexible planar portion and the peripheral web portion. The peripheral web portion has a peripheral sealing bead that is sealingly compressed against a groove in the housing assembly, and a plurality of knob members extend from the peripheral web to press against the switching assembly, thereby accommodating manufacturing dimensional tolerances of the switching mechanism.

23 Claims, 4 Drawing Sheets

LIQUID LEVEL ASSEMBLY WITH DIAPHRAGM SEAL

RELATED APPLICATIONS

This application claims priority to U.S. Provisional application No. 60/458,478 filed Mar. 28, 2003, entitled Liquid Level Assembly With Improved Diaphragm Seal.

BACKGROUND OF THE INVENTION

1. Field of Invention

The present invention relates to the field of fluid transport, and more particularly but not by way of limitation, to an improved liquid level assembly with a diaphragm sealed housing.

2. Discussion

Many functional components, such as electrical switches, must be packaged in various protective housing or containers as may be required to protect the switches from the environment in which the switch is used. Examples can be found in switches used to control the operation of sump, sewage and effluent pumps.

It is known that sealing such switches can suffer deterioration from fluid leakage, and seals for switch supporting housings have not been found adequate when the switches vary dimensionally over a relative wide range of tolerances. Heretofore, a proper seal has not been devised for the proper engagement of the switch and switch support container when a flexible membrane normally used in such switches must be exposed to hostile fluid environment while also accommodating manufacturing tolerances varying widely.

SUMMARY OF THE INVENTION

The present invention provides a liquid level assembly for use in controlling liquid levels between predetermined heights, the liquid level assembly having a switching assembly responsive to the liquid head for sending on and off signals to a pump. A housing has an internal cavity and the switching assembly is supported therein. The housing has an open end communicating with the housing cavity, the open end being sealed by a flexible membrane to transmit pressure of the liquid external to the housing to the switching assembly in the housing cavity.

The seal has a diaphragm with a center planar portion disposed to abut the switching assembly, a peripheral web portion and a flexible bellows portion connecting the planar portion and the peripheral web portion. A plurality of knob members extend from the peripheral web portion and are spatially disposed to press against the switching assembly and the housing to accommodate differences in manufacturing dimensions of the switching assembly.

The advantages and features of the present invention will be apparent from the following description when read in conjunction with the accompanying drawings and appended claims.

DESCRIPTION

In many cases electrical components, such as switches, must be protected from the environment in which the components are used. For instance, in the case of liquid level controllers, the switches must be housed in a protective housing to avoid direct contact with the liquids in which the switches are immersed. For custom designed components, this may involve simply designing a housing with appropriate seals to protect an inner cavity in which the component is disposed. However, where components can vary widely dimensionally, sealing the housing has been problematic.

An example of such is presented with the instance of a liquid level switch that is commonly used to control the operation of various sump, sewage and effluent pumps. The switching mechanism has a pressure responsive, spring biased switching disk, and movement of the switching disk opens and closes contacts disposed in the body of the switching mechanism. The spring has an adjustment screw that permits the force of the switching disk to be preset within predetermined limits.

One such switching mechanism is generally cylindrical in shape, and the body of the switch and its switching disk are held together by a metal band that is swaged around the switch body and the perimeter of the switching disk. This swaging process results in wide dimensional variations of the assembled switch. That is, the final diameter and width of the swaged metal band vary over a wide dimensional range, resulting in a wide tolerance range for the total height of the assembled switching mechanism.

To make the switching mechanism water-tight for use in a target environment, the banded switching mechanism and switching disk are disposed in a plastic housing, and the housing is sealed with a diaphragm seal with a flexible bellows portion that abuts the switching disk. This arrangement causes external pressure that is exerted against the flexible bellows portion to be exerted against the switching disk.

The enclosure of the banded switching mechanism and switching disk in the sealed plastic housing allows the submersion of the switching mechanism in a liquid tank, while protecting the switching mechanism and assuring the integrity of the switching mechanism. Connected to an appropriate pump for the application, the switching mechanism senses the head of liquid above it, and the pump will be turned on or off as required to control the level of the liquid within a preset range.

Figure 1:
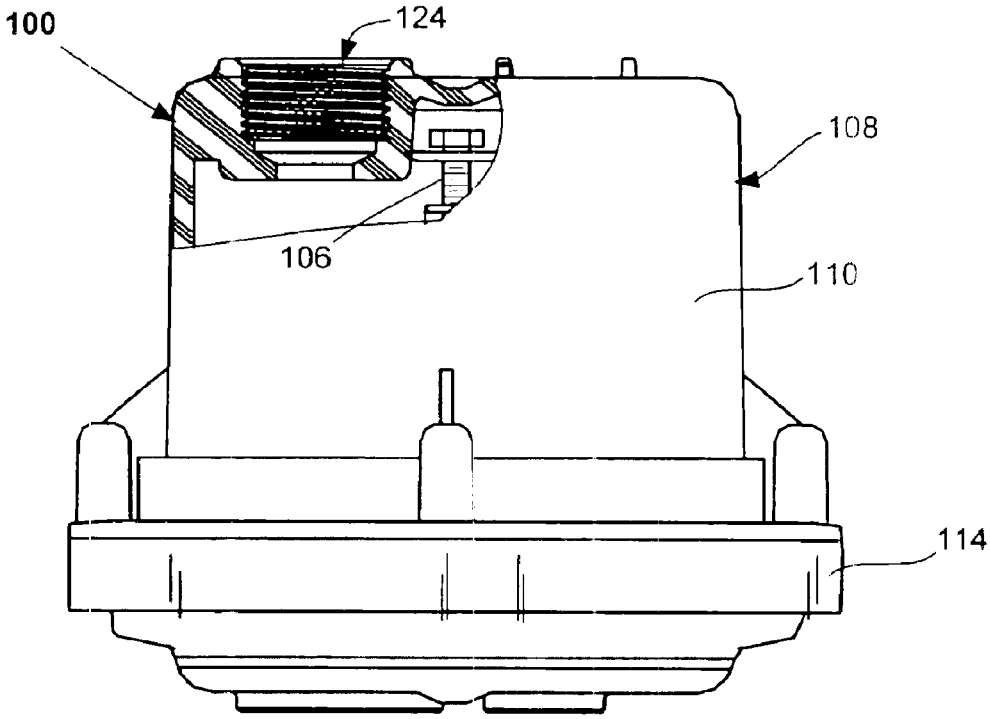
FIG. 1 is an elevational view of a liquid level assembly with a diaphragm seal constructed in accordance with the present invention.
Figure 2:
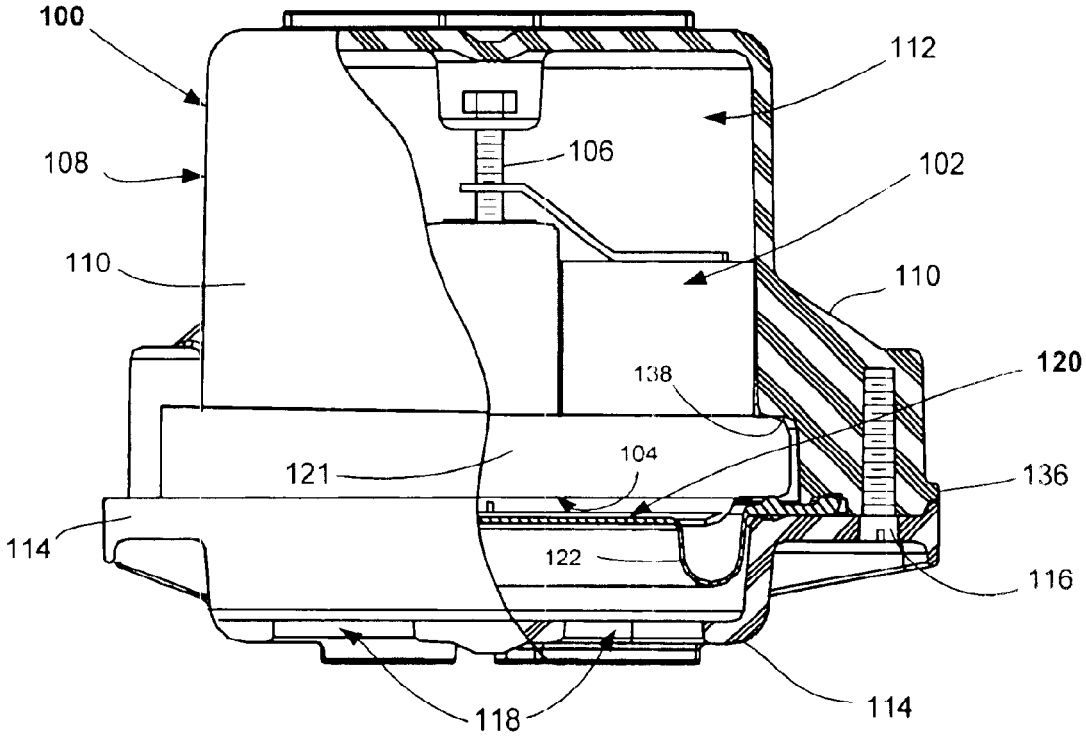
FIG. 2 is a partially cutaway view of the liquid level assembly of FIG. 1.

Turning now to a description of the present invention, shown in FIGS. 1 and 2 is a liquid level assembly 100 constructed in accordance therewith. The liquid level assembly 100 includes a switching mechanism 102 of conventional construction and having a pressure responsive, spring biased switching disk 104 at its bottom. The movement of the switching disk 104 serves to open and close contacts in the switching mechanism 102. An adjustment screw 106 permits the force of the bias spring on the switching disk 104 to be preset within predetermined pressure limits.

The body of the switching mechanism 102 is generally cylindrically shaped, and the switching disk 104 is secured to the body of the switching mechanism 102 by a metal support band 121 that is swaged around the perimeter of the body. This swaging process is not dimensionally consistent, resulting in wide dimensional variations in the height of the assembled switching mechanism 102. That is, the final diameter and width of the swaged metal band has been found to vary over a wide dimensional range, resulting in dimensional variation of the total height of the assembled switching mechanism 102.

To make the switching mechanism 102 water-tight for use in liquid level control in a target environment, the switching mechanism 102 is supported in a plastic housing assembly 108. The housing assembly 108 has an upper housing member 110 that forms an internal cavity 112 in which the switching mechanism 102 is disposed. A lower housing member 114 partially seals the internal cavity 112 at its bottom and is secured to the upper housing member 110 via screws 116. Several openings 118 are provided in the lower housing member 114, and the seal of the internal cavity 112 is completed by the provision of a diaphragm seal 120 secured between the upper housing member 110 and the lower housing member 114.

The diaphragm seal 120 is a flexible member having a flexible bellows portion 122 that abuts against the switching disk 104. The bottom surface of the diaphragm seal 120 is exposed directly to the liquid in the target environment via the openings 118, and the pressure of the liquid is exerted against the flexible bellows portion 122 so as to move the switching disk 104. The diaphragm seal 120 is preferably made of a flexible, compressible material, such as Nitrile, or other suitable elastomer, and preferably having a durometer range of about 40 to 60.

The enclosure of the banded switching mechanism and switching disk 104 in the sealed plastic housing assembly 108 allows submersion of the switching mechanism 102 in a liquid environment, such as in a tank (not shown), while protecting and ensuring the integrity of the switching mechanism 102. A wiring conduit (not shown) is extended through a threaded opening 124 in the upper housing member 110 to connect to the switching mechanism 102. The wiring conduit connects to an appropriate pump for a particular application, and the switching mechanism 102 senses the head of liquid on the diaphragm seal 120 so that the pump will be turned on or off as required to control the level of the liquid within a preset range.

Figure 3:
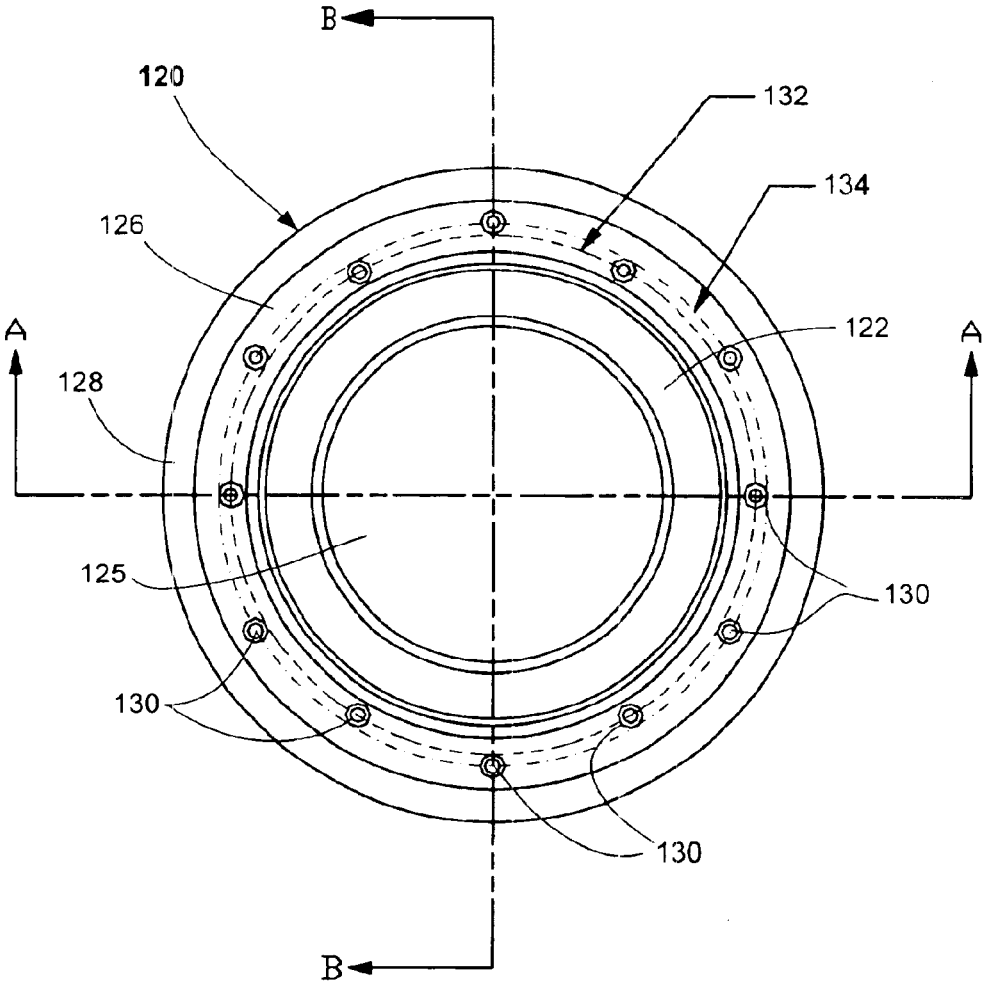
FIG. 3 is a plan view of the diaphragm seal of FIG. 1.
Figure 4:
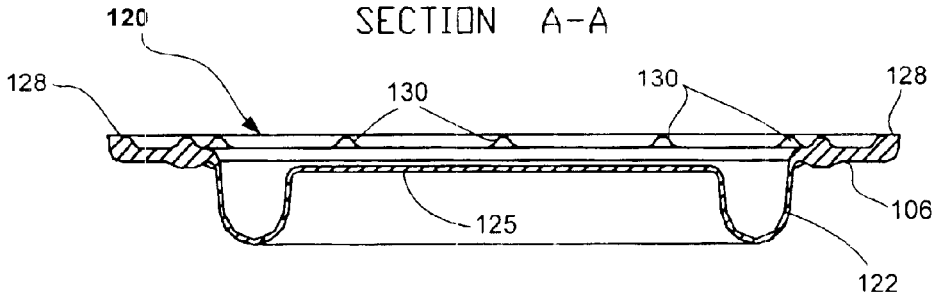
FIG. 4 is a side elevational view of the diaphragm seal taken at A—A in FIG. 3.
Figure 5:
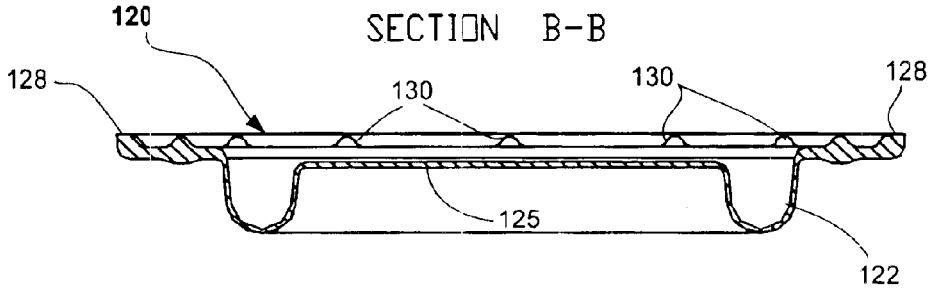
FIG. 5 is a side elevational view of the diaphragm seal taken at B—B in FIG. 3.

Turning now to the drawings and more particularly to FIG. 3, shown therein is the diaphragm seal 120, and FIGS. 4 and 5 more clearly show the improvement of the present invention. The diaphragm seal 120 is a flexible member having the bellows portion 122 separating a center flexible planar portion 125 from a peripherally extending web portion 126. Outboard on the peripheral web portion 126 is a sealing bead 128.

A plurality of knob portions 130 are integrally formed with, and extend upwardly from, the peripheral web portion 126. The knob portions 130 are spatially and radially disposed on the web portion 126 to abut against the switching mechanism 102, in a manner made clear below.

Several of the knob portions 130 are disposed along an inner circular pattern 132, and the remaining knob portions 130 are disposed along an outer circular pattern 134, as shown. The number of knob portions 130 provided on the peripheral web portion 126 is not believed to be critical; rather, the number of such knob portions 130 will be empirically determined for each specific application. Also, while inner and outer circular patterns are depicted, it will be appreciated that in some cases a single circular pattern can be utilized, and in other applications it may be desirable to arrange the knob portions in other patterns.

Returning to FIGS. 1 and 2, and as above noted, the switching mechanism 102 is supported in the plastic housing assembly 108. The upper housing member 110 has an open end 136 that is closed by the lower housing member 114. The internal diameter of the upper housing member 110 provides a shoulder recess 138 to accept the support band 121 as shown. The dimension between the shoulder recess 138 and the bottom of the upper housing member 110 is determined to accommodate the support band 121 at its maximum dimension.

Figure 6:
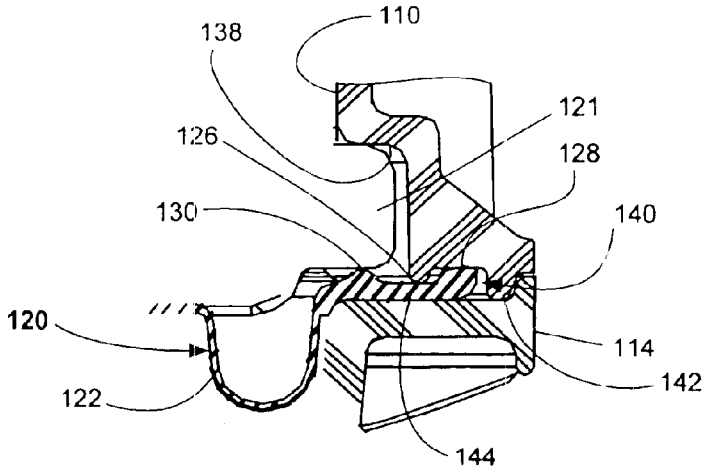
FIG. 6 is a partial cutaway view, in enlargement, of one corner of the liquid level assembly of FIG. 1.

The diaphragm seal 120 is pressed against and across the open end of the upper housing member 110 by the lower housing member 114, which presses against the peripheral web portion 126. As best shown in FIG. 6, a groove 140 is provided in the lower edge of the upper housing member 110, an outer land rim 142 and an inner land rim 144 bordering the groove 140 as shown. The dimensions of the outer and inner land rims 142, 144 are determined to sealingly accommodate the thickness dimensions of the diaphragm seal 120 and the peripheral bead 128 as shown. The sealing bead 128 of the diaphragm seal 120 is pressed into the groove 140 by the lower housing member 114 and the screws 116 to seal the housing cavity 112 of the housing assembly 108.

The openings 118 in the lower housing member 114 permit the liquid environment to apply head pressure against the flexible planar portion 125 of the diaphragm seal 120 to move the switching disk 104 to actuate the switching mechanism 102, which in turn signals a pump (not shown) to operate to remove liquid from the tank until the head pressure against the switching disk 104 is reduced, thereby adjusting the liquid level.

The bellows portion 122 of the diaphragm seal 120 extends downwardly and upwardly, as shown, to hold the flexible planar portion 125 of the diaphragm seal 120 against, or slightly separated from, the switching disk 104. The knob portions 130 extending from the peripheral web portion 126 are positioned to abut the under surface of the support band 121 and to press the support band 121 against the shoulder recess 138. FIG. 4 shows the knob portions 130 that are disposed along the inner circular pattern 132, and FIG. 5 shows the knob portions 130 that are disposed along the outer circular pattern 134.

The diaphragm seal 120 as used in the liquid level assembly 100 serves three purposes: 1) the diaphragm seal 120 contains the built-in sealing bead 128 that, when compressed into sealing engagement with the groove 140 in the lower end of the upper housing member 110, prevents water (or other surrounding liquid) from entering the housing cavity 112, thereby protecting the switching mechanism 102; 2) the diaphragm seal 120 provides a built-in bellows portion 122 that allows the center flexible planar portion 125 to move up and down to actuate the switching mechanism 102; and 3) the diaphragm seal 120 provides a series of compressible knob portions 130 that are compressed against, and holds, the switching mechanism 102 in a set, firm position within the housing cavity 112 of the housing assembly 108.

Assembly of the liquid level assembly 100 proceeds as follows: the switching mechanism 102 is placed into the housing cavity 112 of the upper housing member 110. The diaphragm seal 120 is then placed over the switching mechanism 102 and against the bottom edge of the upper housing member 110, with the sealing bead 128 in the groove 140.

The lower housing member 114 is then placed against the bottom of the peripheral web portion 126 of the diaphragm seal 120 and mechanically fastened to the housing by the screws 116, compressing the sealing bead 128 into firm engagement with the groove 140. At the same time the sealing bead 128 is being compressed, the knob portions 130 are moved upward into engagement with the support band 121. The arrangement of the knob portions 130 in the two circular patterns 132, 134 assures that the support band 121 is always contacted by most, if not all, of the knob portions 130 to physically and firmly hold the switching mechanism 102 in place, thereby preventing potential movement of the switching mechanism 102 in the housing cavity 112.

For purposes of this description, it has been assumed that the liquid level assembly 100 is used in an application in which the liquid in a tank is periodically removed to maintain the liquid level between predetermined set point levels that are determined by adjustment of the screw 106. It will be appreciated that the liquid level assembly 100 could as well be utilized in an application in which liquid is pumped into a tank to maintain the liquid level between predetermined set point levels.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. A liquid level assembly for use with a pump, comprising:

switching means responsive to liquid head pressure for actuating the pump;

a housing having an internal cavity in which the switching means is supported and having an open end;

seal means for sealing the open end of the housing and for transmitting pressure of the liquid head to the switching means, the seal means comprising:

a diaphragm seal having a center planar portion disposed to abut the switching means, a peripherally extending web portion and a flexible bellows portion connecting the planar portion and the peripheral web portion; and a plurality of knob members extending from the peripheral web portion disposed to press against the switching means.

2. The liquid level assembly of claim 1 wherein the housing comprises:

an upper housing member, the internal cavity being therein;

a lower housing member; and means for attaching the lower housing member to the upper housing member, the seal means being disposed between the lower housing member and the upper housing member, and the internal cavity sealed thereby.

3. The liquid level assembly of claim 2 wherein the lower housing member has at least one opening whereby liquid head pressure is exerted on the diaphragm seal.

4. The liquid level assembly of claim 3 wherein the diaphragm seal has a peripheral sealing bead, and wherein the upper housing member has a lower edge about the at least one opening of the internal cavity, the lower edge having a groove, the peripheral sealing bead sealingly engaging the groove when the lower housing member is attached to the upper housing member.

5. The liquid level assembly of claim 4 wherein the upper housing member has an outer land rim and an inner land rim, and wherein the groove is therebetween, the dimension of the outer and inner land rims is determined to sealingly accommodate the thickness dimensions of the diaphragm seal and the peripheral sealing bead thereof.

6. The liquid level assembly of claim 5 wherein the housing assembly has a shoulder recess, and wherein the knob members press the switching means thereagainst.

7. The liquid level assembly of claim 6 wherein some of the knob members are arranged in an outer circular path.

8. The liquid level assembly of claim 7 wherein some of the knob members are arranged in an inner circular path.

9. The liquid level assembly of claim 1 wherein the housing assembly has a shoulder recess, and wherein the knob members press the switching means thereagainst.

10. The liquid level assembly of claim 9 wherein some of the knob members are arranged in an outer circular path.

11. The liquid level assembly of claim 10 wherein some of the knob members are arranged in an inner circular path.

12. A liquid level assembly for immersion in a liquid and for use with a pump, comprising:

a housing assembly comprising:

an upper housing member forming a housing cavity;

a lower housing member; and means connecting the lower housing member to the upper housing member;

a switching mechanism supported in the housing cavity and connectable to the pump for actuating the pump in response to liquid head pressure;

a diaphragm seal disposed between the upper housing member and the lower housing member to seal the housing cavity, the lower housing member having at least one opening whereby the diaphragm seal is subjected to liquid head pressure, the diaphragm seal having a flexible portion disposed to abut and actuate the switching mechanism, the diaphragm seal having a plurality of knob members that cooperate with the upper and lower housing members to support the switching mechanism.

13. The liquid level assembly of claim 12 wherein the diaphragm seal has a peripheral sealing bead, and wherein the upper housing member has a lower end that surrounds the at least one opening of the housing cavity, a lower end of the upper housing member having a groove, the peripheral sealing bead sealingly engaging the groove when the lower housing member is attached to the upper housing member.

14. The liquid level assembly of claim 13 wherein the upper housing member has an outer land rim and an inner land rim bordering the groove, and wherein the dimension of the outer and inner land rims are determined to sealingly accommodate the thickness dimensions of the diaphragm seal and the peripheral sealing bead thereof.

15. The liquid level assembly of claim 14 wherein a shoulder recess is formed within the upper housing member and wherein the knob members extending from the diaphragm seal are disposed to press the switching mechanism against the shoulder recess.

16. The liquid level assembly of claim 15 wherein some of the knob members are arranged in a first circular path.

17. The liquid level assembly of claim 16 wherein some of the knob members are arranged in a second inner circular path.

18. In a liquid level assembly immersible in a liquid to actuate a pump in response to liquid head pressure in which the liquid level assembly has a housing assembly having a housing cavity formed by a first housing member and a second housing member attached thereto, a switching mechanism being supported in the housing cavity, the improvement comprising:

a diaphragm seal disposed between the first housing member and the second housing member to seal the housing cavity, the lower housing member having at least one opening whereby the diaphragm seal is subjected to liquid head pressure, the diaphragm seal having a flexible portion disposed to abut and actuate the switching mechanism, the diaphragm seal having a plurality of knob members that cooperate with the first and second housing members to press the switching mechanism so that dimensional tolerances of the switching mechanism are accommodated.

19. The liquid level assembly of claim 18 wherein the diaphragm seal has a peripheral sealing bead, and wherein the first housing member has a lower end the housing cavity and having a sealing groove, the peripheral sealing bead of the diaphragm seal engaging the groove when the first and second housing member are connected.

20. The liquid level assembly of claim 19 wherein the first housing member has an outer land rim and an inner land rim bordering the sealing groove, and wherein the dimensions of the outer and inner land rims are determined to sealingly accommodate the thickness dimensions of the diaphragm seal and the peripheral sealing bead thereof.

21. The liquid level assembly of claim 20 wherein a shoulder recess is formed within the first housing member and wherein the knob members extending from the diaphragm seal are disposed to press the switching mechanism against the shoulder recess when the first and second housing members are connected.

22. The liquid level assembly of claim 21 wherein some of the knob members are arranged in a first circular path.

23. The liquid level assembly of claim 22 wherein some of the knob members are arranged in a second circular path.

* * * * *